US009624057B2

(12) United States Patent
Itabashi et al.

(10) Patent No.: US 9,624,057 B2
(45) Date of Patent: Apr. 18, 2017

(54) SHEET FEEDER AND IMAGE FORMING APPARATUS

(71) Applicant: CANON KABUSHIKI KAISHA, Tokyo (JP)

(72) Inventors: Toshifumi Itabashi, Moriya (JP); Kakeru Takahashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,754

(22) Filed: Mar. 22, 2016

(65) Prior Publication Data

US 2016/0282788 A1 Sep. 29, 2016

(30) Foreign Application Priority Data

Mar. 25, 2015 (JP) ..... 2015-062574

(51) Int. Cl.
*B65H 5/36* (2006.01)
*B65H 1/26* (2006.01)
(Continued)

(52) U.S. Cl.
CPC ..... *B65H 5/36* (2013.01); *B65H 1/266* (2013.01); *B65H 3/66* (2013.01); *B65H 2404/60* (2013.01); *B65H 2405/1136* (2013.01); *B65H 2405/13* (2013.01); *B65H 2405/141* (2013.01); *G03G 15/6511* (2013.01); *G03G 2215/00396* (2013.01); *G03G 2215/0132* (2013.01)

(58) Field of Classification Search
CPC ..... B65H 5/36; B65H 1/266; B65H 2404/60; B65H 2405/13; B65H 2405/141; B65H 3/52; B65H 3/5207; B65H 3/5215; B65H 3/66; B65H 3/68; B65H 2405/113; B65H 2405/1136
See application file for complete search history.

(56) References Cited

U.S. PATENT DOCUMENTS 8,113,505 B2 * 2/2012 Lee ..... B65H 3/5223 271/121
8,651,476 B2 * 2/2014 Bingham ..... B65H 3/56 271/121
(Continued)

FOREIGN PATENT DOCUMENTS

JP H08290846 A 11/1996

*Primary Examiner* — Patrick Cicchino
(74) *Attorney, Agent, or Firm* — Canon U.S.A. Inc., IP Division

(57) ABSTRACT

A sheet feeder includes a sheet feeding unit configured to feed a sheet from a sheet storage case in a sheet feeding direction orthogonal to a loading direction in which the sheet storage case is loaded into an apparatus main body, and a conveying guide configured to guide the sheet fed by the sheet feeding unit. The conveying guide includes a first guide segment included in the apparatus main body and a second guide segment included in the sheet storage unit. The sheet feeder further includes an edge guide member disposed at an end of the first guide segment. The edge guide member has a guide surface that allows reaction force including a directional force component acting upward and a directional force component acting in a direction opposite to the sheet feeding direction to be generated when the sheet partly projecting from the sheet storage case abuts the guide surface.

15 Claims, 8 Drawing Sheets

(51) Int. Cl.
*B65H 3/66* (2006.01)
*G03G 15/00* (2006.01)

(56) References Cited

U.S. PATENT DOCUMENTS

| | | | | |
|---|---|---|---|---|
| 8,695,965 | B2 * | 4/2014 | Shin | B65H 1/266 271/121 |
| 9,440,809 | B2 * | 9/2016 | Kuwata | B65H 1/04 |
| 2016/0060050 | A1 * | 3/2016 | Iwama | B65H 1/14 271/147 |
| 2016/0107852 | A1 * | 4/2016 | Yamamoto | B65H 1/266 271/10.09 |

* cited by examiner

SHEET FEEDER AND IMAGE FORMING APPARATUS

BACKGROUND OF THE INVENTION

Field of the Invention

The present invention relates to a sheet feeder that feeds a sheet to an image forming unit for forming an image on a sheet and an image forming apparatus including the sheet feeder.

Description of the Related Art

A typical image forming apparatus, such as a copier or a printer, includes an image forming unit for forming an image on a sheet, such as plain paper, coated paper, or film paper, and a sheet feeder for supplying a sheet to the image forming unit. The sheet feeder includes a sheet storage case (e.g., a sheet cassette) for storing sheets. A user places sheets for image formation in the sheet storage case and loads the sheet storage case into a main body (hereinafter, "apparatus main body") of the image forming apparatus. A sheet feeding unit including a feed roller and a separation roller separates sheets, which are stored in the sheet storage case loaded in the apparatus main body, one by one and then feeds the separated sheet to the image forming unit.

Some image forming apparatuses are configured such that the sheet storage case is unloaded from the apparatus main body in a direction orthogonal to a sheet feeding direction in which a sheet is fed from the sheet storage case loaded in the apparatus main body. This configuration is called a front loading type in which the sheet storage case is loaded into the image forming apparatus from a front side of the apparatus, and the sheet feeding unit feeds a sheet from the loaded sheet storage case in the direction orthogonal to the direction in which the sheet storage case is loaded into the image forming apparatus.

In this configuration, a top sheet of a sheet bundle stored in the sheet storage case may abut a component, for example, the sheet feeding unit, of the apparatus main body while a user loads the sheet storage case into the apparatus main body after the user places sheets in the sheet storage case. In particular, when sheets stored in the sheet storage case correspond to a maximum loading capacity of the sheet storage case, or alternatively, when sheets are warping (curling), such a phenomenon tends to occur.

If a sheet stored in the sheet storage case abuts an internal component of the apparatus main body and is caught by the component during loading of the sheet storage case into the apparatus main body, the sheet may be damaged, for example, broken, or the orientation of the sheet may be significantly changed. The changed orientation of the sheet causes sheet misfeed (e.g., sheet jam (hereinafter, "jam") or sheet skew feed (hereinafter, "skew feed")) when the sheet feeding unit feeds the sheet from the sheet storage case loaded in the apparatus main body.

To prevent a sheet in the sheet storage case from being caught during loading of the sheet storage case into the apparatus main body, for example, a recently developed image forming apparatus has a configuration in which a feed roller has at one end a sheet guide surface (refer to Japanese Patent Laid-Open No. 8-290846). In this configuration, if sheets stored in the sheet storage case have curling ends, the sheets are guided by the guide surface at the end of the feed roller during loading of the sheet storage case into the apparatus main body. Consequently, the sheet storage case can be smoothly loaded into the apparatus main body without any damage to the stored sheets.

When the sheet storage case is loaded into the apparatus main body, sheets stored in the sheet storage case may be insufficiently regulated such that an end of a sheet partly projects from the sheet storage case in the sheet feeding direction. In such a state, projecting part of the sheet may abut a component other than the feed roller of the apparatus main body during loading of the sheet storage case into the apparatus main body. For example, the end of the sheet projecting from the sheet storage case may abut a conveying guide, disposed in the vicinity of the sheet feeding unit, for guiding a sheet fed by the sheet feeding unit. Disadvantageously, the sheet may be damaged or the orientation of the sheet may be significantly changed, causing sheet misfeed, such as jam or skew feed.

The above-described disadvantage, however, is not overcome by the related-art configuration in which the end of the feed roller has the sheet guide surface as described in Japanese Patent Laid-Open No. 8-290846.

SUMMARY OF THE INVENTION

An aspect of the present invention provides a sheet feeder including a sheet storage unit that stores a sheet and that is loadable into an apparatus main body, a sheet feeding unit configured to feed the sheet from the sheet storage unit in a second direction orthogonal to a first direction in which the sheet storage unit is loaded into the apparatus main body, and a conveying guide configured to guide the sheet fed in the second direction by the sheet feeding unit. The conveying guide includes a first guide segment included in the apparatus main body and a second guide segment included in the sheet storage unit. The second guide segment is aligned with the first guide segment in the first direction while the sheet storage unit is loaded in the apparatus main body. The sheet feeder further includes an edge guide member disposed at an upstream end of the first guide segment in the first direction. The edge guide member has a guide surface shaped to, when the sheet abuts the guide surface, generate reaction force including a force component, serving as a directional component, acting upward and a force component, serving as a directional component, acting in a direction opposite to the second direction.

Another aspect of the present invention provides a sheet feeder including a sheet storage unit that stores a sheet and that is loadable into an apparatus main body, a sheet feeding unit configured to feed the sheet from the sheet storage unit in a second direction orthogonal to a first direction in which the sheet storage unit is loaded into the apparatus main body, and a conveying guide configured to guide the sheet fed in the second direction by the sheet feeding unit. The conveying guide includes a first guide segment included in the apparatus main body and a second guide segment included in the sheet storage unit. The second guide segment is aligned with the first guide segment in the first direction while the sheet storage unit is loaded in the apparatus main body. The sheet feeder further includes an edge guide member that is disposed at an upstream end of the first guide segment in the first direction and against which the sheet partly projecting from the sheet storage unit is allowed to abut during loading of the sheet storage unit into the apparatus main body. The edge guide member has a guide surface that raises projecting part of the sheet and moves the sheet in a direction opposite to the second direction simultaneously or continuously.

Further features of the present invention will become apparent from the following description of exemplary embodiments with reference to the attached drawings.

DESCRIPTION OF THE EMBODIMENTS

A general embodiment of the present invention will be described. An exemplary configuration of a color image forming apparatus (copier) including a sheet feeder according to the general embodiment will now be described with reference to FIG. 8.

Figure 8:
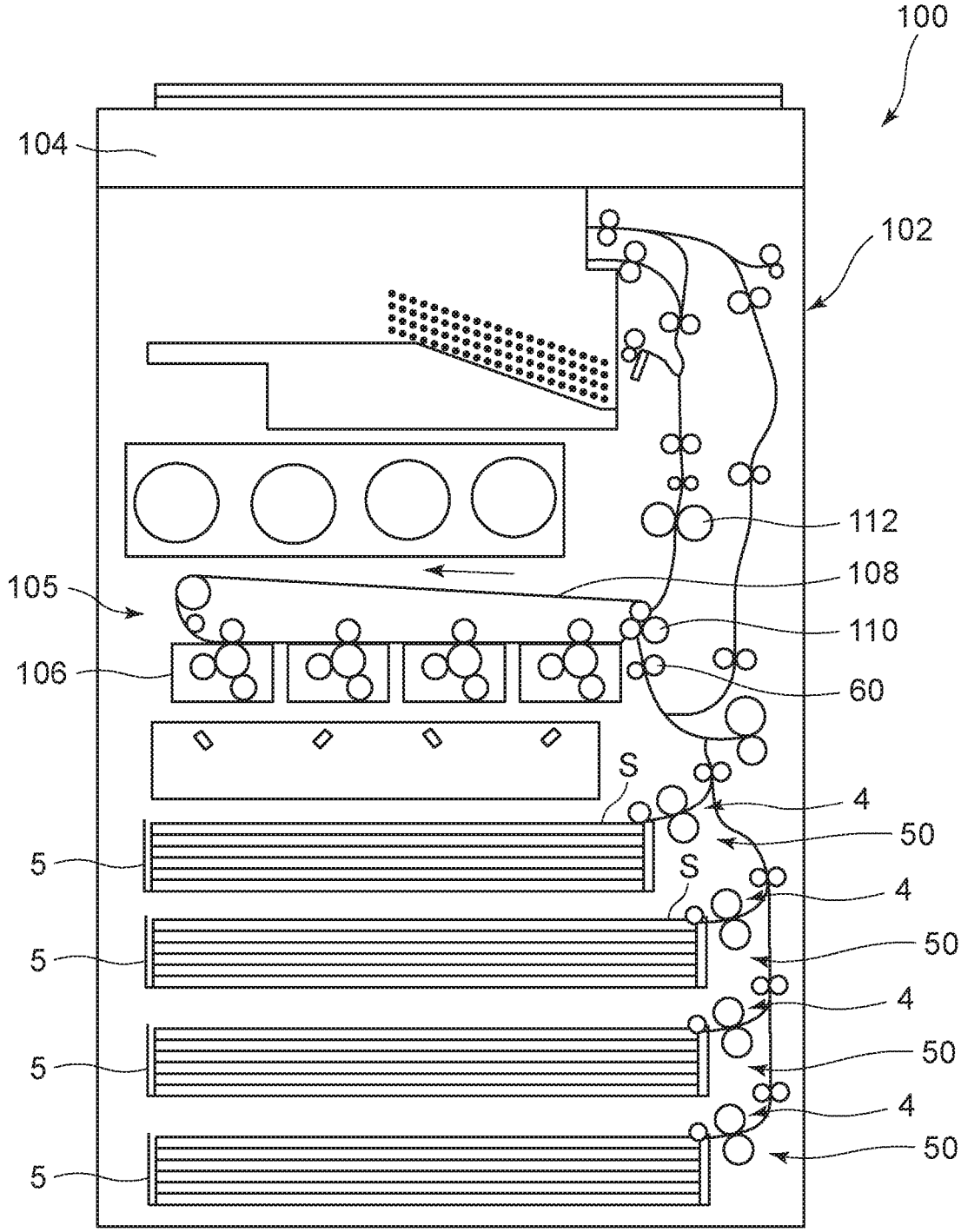
FIG. 8 is a sectional view of an image forming apparatus including a sheet feeder according to a general embodiment of the present invention.

As illustrated in FIG. 8, an image forming apparatus 100 includes an apparatus main body 102 accommodating an image forming section 105 for forming a color image on a sheet, such as plain paper, coated paper, or film paper. The image forming apparatus 100 further includes an image reader 104 for reading an image on a sheet. The image reader 104 is disposed on the top of the apparatus main body 102. The image reader 104 reads an image of a document, converts the image into image data, and transfers the image data to a control unit disposed in the apparatus main body 102.

The apparatus main body 102 accommodates the image forming section 105 for forming an image on a sheet. The image forming section 105 forms an image on a sheet by using electrophotography. The image forming section 105 includes image forming units 106 for different colors (yellow, magenta, cyan, and black). The image forming units 106 each include a photoconductive drum. A toner image is formed on the photoconductive drum of each of the image forming units 106 in accordance with image data from the image reader 104 or an external input unit. The formed toner images are sequentially subjected to primary transfer to an intermediate transfer member (intermediate transfer belt) 108. The toner images transferred to the intermediate transfer member 108 are subjected to secondary transfer to a sheet by a transfer roller 110. The sheet with the secondarily transferred toner images is conveyed to a fixing section 112, where the toner images are fixed to the sheet.

The apparatus main body 102 accommodates, in lower part, a plurality of sheet feeders 50 for feeding stored sheets one by one to the image forming section 105. The sheet feeders 50 each include a sheet storage case 5, serving as a sheet storage unit that stores sheets and is loadable into and unloadable from the apparatus main body 102, and a sheet feeding unit 4 for separating sheets one by one and feeding the separated sheet from the sheet storage case 5.

First Embodiment

The entire structure of a sheet feeder 50 according to a first embodiment will be described with reference to FIGS. 2A, 2B, 3, and 6.

Figure 2A:
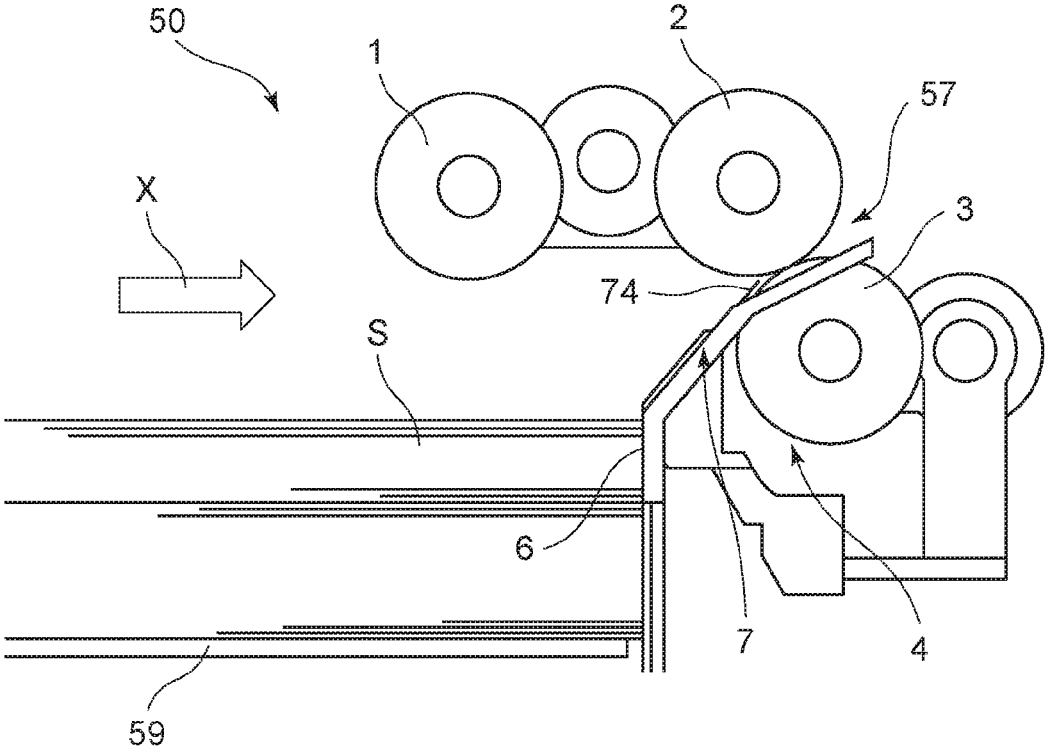
FIG. 2A is a sectional view of the sheet feeder of FIGS. 1A and 1B.
Figure 2B:
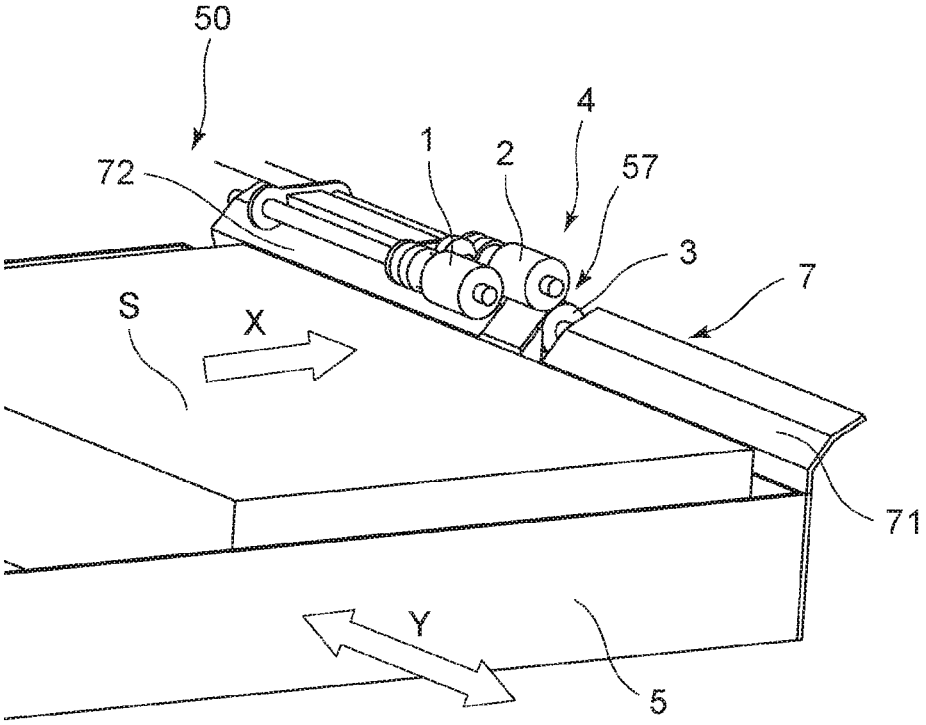
FIG. 2B is a perspective view of the sheet feeder of FIGS. 1A and 1B.

As illustrated in FIGS. 2A and 2B, a sheet feeding unit 4 includes a pickup roller 1 for feeding sheets S stacked in a sheet storage case 5, serving as a sheet storage unit, and a separation portion 57 for separating sheets fed by the pickup roller 1 one by one. The separation portion 57 includes a feed roller 2 for conveying the sheet S fed by the pickup roller 1 and a separation roller 3 for separating sheets fed by the pickup roller 1 one by one. The separation roller 3 is allowed to be in pressure contact with the feed roller 2. The rollers 1, 2, and 3 are fixed to first ends of cantilever shafts, whose second ends farther from the viewer in FIGS. 2A and 2B are held by the apparatus main body 102 at the back of the apparatus main body 102.

The sheet storage case 5 includes a side regulating plate (not illustrated) that regulates the position of a side edge (edge orthogonal to the sheet feeding direction) of a sheet bundle stored, and further includes a trailing edge regulating plate (not illustrated) that regulates a trailing edge of the sheet bundle. These regulating plates position the stored sheet bundle at a sheet storage position in the sheet storage case 5. The sheet storage case 5 further includes a sheet supporting member (lifting plate) 59 that supports the stored sheet bundle and raises the uppermost sheet S of the sheet bundle to a position at which the sheet S can be fed by the sheet feeding unit 4. The sheet supporting member 59 is located at a low level before the sheet storage case 5 is loaded into the apparatus main body 102. After the sheet storage case 5 is loaded in the apparatus main body 102, the sheet supporting member 59 is moved to a higher level by a lifter mechanism (not illustrated).

The sheet storage case 5 is loadable into and unloadable from the apparatus main body 102 in a widthwise direction Y orthogonal to the sheet feeding direction, indicated at X, (second direction) in which the sheet S is fed. The sheet storage case 5 is loaded into the apparatus main body 102 in a first direction (hereinafter, also referred to as a "loading direction"). The sheet storage case 5 further includes a leading-edge wall 6 for regulating the position of a leading edge of the bundle of sheets stacked in the sheet storage case 5. The leading-edge wall 6 is located at a downstream end of the sheet storage case 5 in the sheet feeding direction X. The sheet feeder 50 further includes a conveying guide 7 for guiding a sheet fed by the sheet feeding unit 4. The conveying guide 7 is located downstream of the sheet storage case 5 in the sheet feeding direction X.

The conveying guide 7 extends along one end of the sheet storage case 5 in the widthwise direction Y. The conveying guide 7 includes a second guide segment 71 and a first guide segment 72. The second guide segment 71 is integrated with upstream part of the sheet storage case 5 in the loading direction. The first guide segment 72 is located at the back of the apparatus main body 102. In other words, the conveying guide 7 includes the two guide segments, the second guide segment 71 included in the sheet storage case 5 and the first guide segment 72 included in the apparatus main body 102. The second guide segment 71 is aligned with the first guide segment 72 in the widthwise direction Y while the sheet storage case 5 is loaded in the apparatus main body 102. The first guide segment 72 extends from a downstream side of the sheet storage case 5 in the loading direction to an area in the vicinity of upstream ends (closer to the viewer in FIG. 2B) of the pickup roller 1 and the rollers 2 and 3 of the separation portion 57 in the loading direction. The second guide segment 71 is located upstream of the first guide segment 72 in the loading direction.

The sheet feeding unit 4 is disposed in substantially the middle (or a position corresponding to the middle of the sheet storage case 5 in the widthwise direction Y) of a sheet conveyance area in the widthwise direction Y. The first guide segment 72 and the second guide segment 71 are accordingly separated from each other at substantially the middle of the sheet conveyance area in the widthwise direction Y. The second guide segment 71 and the first guide segment 72 each have a sheet guide surface that slopes. The sheet guide surfaces of the second guide segment 71 and the first guide segment 72 have substantially the same shape. The second guide segment 71 and the first guide segment 72 are aligned with each other in the widthwise direction Y while the sheet storage case 5 is loaded in the apparatus main body 102.

A nip guide member 74 for guiding the sheet S fed by the pickup roller 1 to the nip between the feed roller 2 and the separation roller 3 is fixed to the first guide segment 72. The nip guide member 74 is a thin plate of, for example, metal or plastic, and is elastically deformable. The sheet guide surfaces of the first guide segment 72 and the second guide segment 71 are substantially flush with a sheet guide surface of the nip guide member 74.

Figure 6:
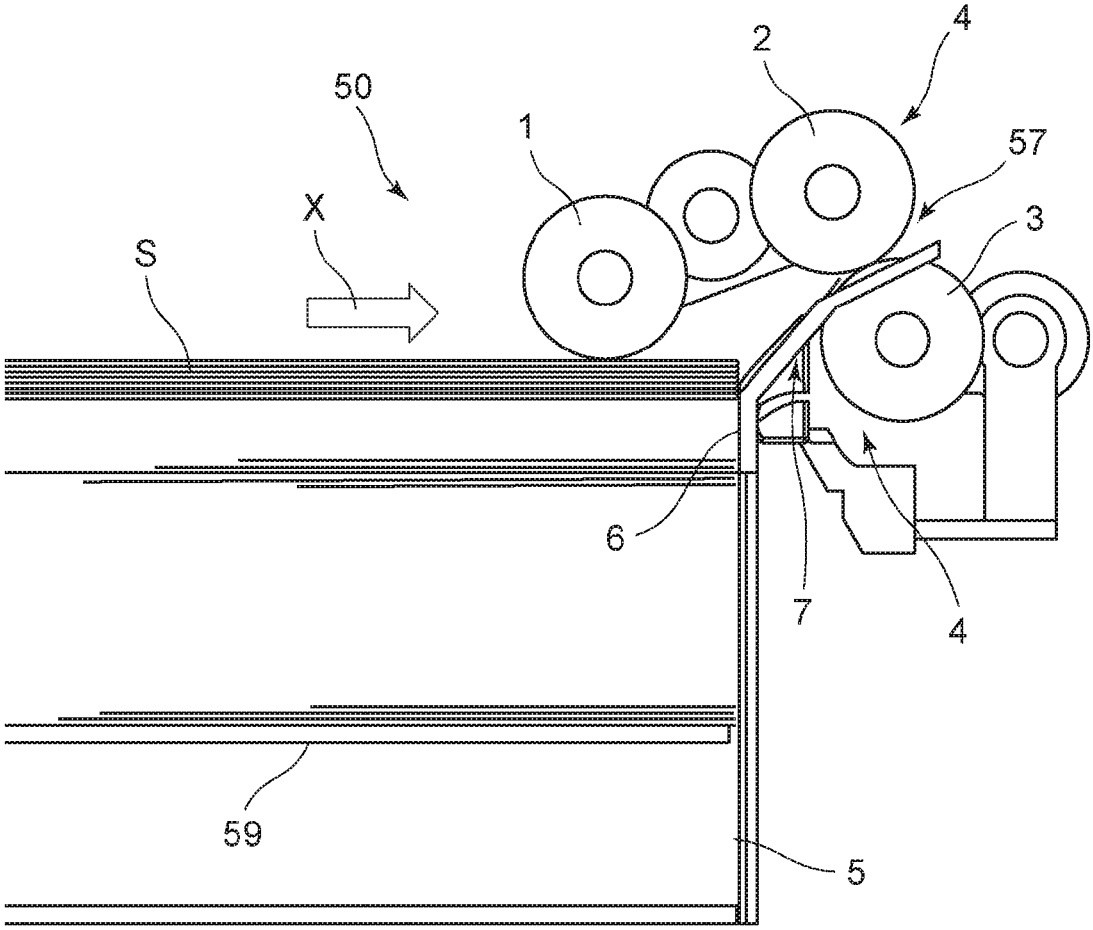
FIG. 6 is a sectional view of the sheet feeder of FIGS. 1A and 1B in a sheet feeding state.

Referring to FIG. 6, the pickup roller 1 is pressed against an upper surface of the uppermost sheet S of the bundle of sheets stacked on the sheet supporting member 59. When receiving driving power, the pickup roller 1 rotates, thus feeding the sheet S to the separation portion 57. The conveying guide 7 guides the sheet separated and fed by the separation portion 57, so that the sheet is fed downstream to a registration unit 60 disposed upstream of the image forming section 105 in the sheet feeding direction X. The registration unit 60 corrects skew of the fed sheet S and feeds the skew-corrected sheet S at predetermined timing so that images are formed at proper positions in the image forming section 105.

Figure 3:
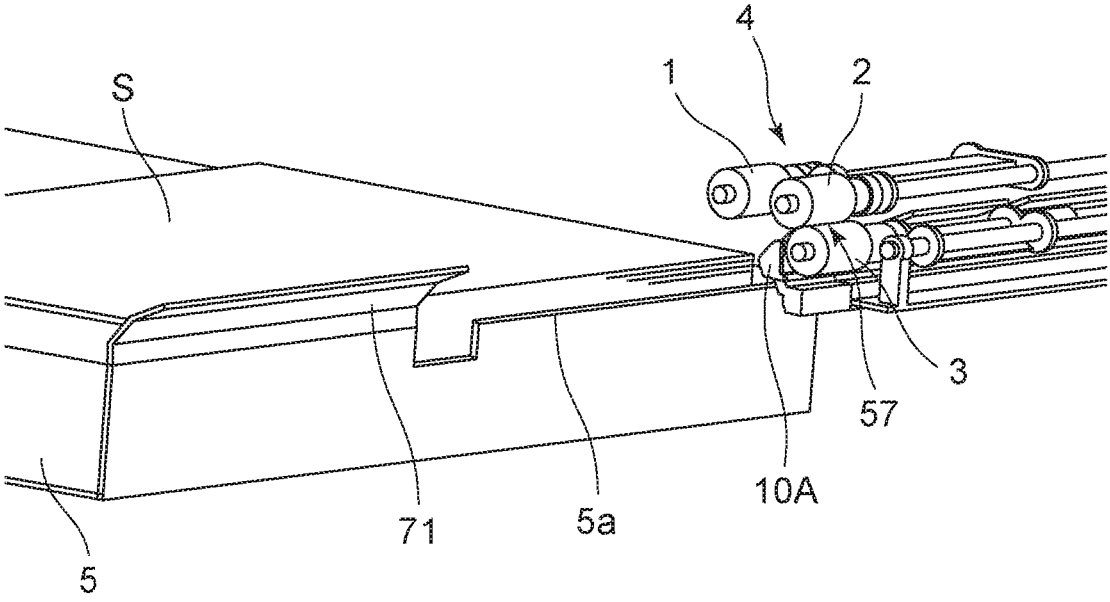
FIG. 3 is a perspective view of the sheet feeder of FIGS. 1A and 1B as viewed from a downstream side in a sheet feeding direction.

The sheet feeder 50 according to the present embodiment will be further described with reference to FIGS. 2A to 3.

As described above, the second guide segment 71 included in the sheet storage case 5 does not extend all along the end (facing the leading edge of the sheet bundle) of the sheet storage case 5 in the widthwise direction Y. The first guide segment 72, located farther from the viewer in FIG. 2B, of the conveying guide 7 is included in a sheet feeding frame that supports the sheet feeding unit 4. The sheet feeding frame is fixed to the apparatus main body 102. As illustrated in FIG. 3, the leading-edge wall 6 of the sheet storage case 5 has a recess 5*a* shaped to avoid contact with an upstream end portion of the first guide segment 72 in the sheet feeding direction X. The first guide segment 72 engages with the recess 5*a*, so that a vertically extending surface of the upstream end portion of the first guide segment 72 regulates the leading edge of the bundle of sheets stacked. In other words, while the sheet storage case 5 is loaded in the apparatus main body 102, the first guide segment 72 is located in the recess 5*a* such that the vertically extending surface of the upstream end portion of the first guide segment 72 in the sheet feeding direction X is substantially flush with the leading-edge wall 6 of the sheet storage case 5.

As described above, the conveying guide 7 is composed of the segment included in the sheet storage case 5 and the segment included in the apparatus main body 102. In addition, the leading-edge wall 6 is composed of the segment included in the sheet storage case 5 and the segment included in the apparatus main body 102. The reason why each of the conveying guide 7 and the leading-edge wall 6 is composed of the segment included in the sheet storage case 5 and the segment included in the apparatus main body 102 will now be described.

For example, if the conveying guide 7 is integrated with the end of the sheet storage case 5 such that the conveying guide 7 extends along the conveyance area, where the sheet S is conveyed, in the widthwise direction Y, the conveying guide 7 may interfere with the sheet feeding unit 4 when the sheet storage case 5 is loaded into the apparatus main body 102 in the widthwise direction Y. Specifically, when the sheet storage case 5 is loaded into the apparatus main body 102, the conveying guide 7 may hit the sheet feeding unit 4 depending on the mounting position of, for example, a rail for guiding movement of the sheet storage case 5 in the apparatus main body 102, variations in size of components, or variation in mounting position of the sheet feeding unit 4. To prevent interference between the sheet storage case 5 and the conveying guide 7, a space would have to be formed in the sheet feeding direction X between the sheet storage case 5 and the conveying guide 7. The sheet storage case 5 therefore would have to be far enough away from the sheet feeding unit 4, resulting in an increase in size of the sheet feeder.

According to the present embodiment, the second guide segment 71 is integrated with the upstream part of the sheet storage case 5 in the loading direction such that the second guide segment 71 is located in an area where the rollers 1, 2, and 3 of the sheet feeding unit 4 are not arranged. The first guide segment 72 is included in the apparatus main body 102 such that the first guide segment 72 is located in downstream part of the sheet storage case 5 in the loading direction. In addition, the sheet storage case 5 has the recess 5*a* that is located in the downstream part of the sheet storage case 5 in the loading direction so as to avoid the first guide segment 72 in order to prevent the interference between the first guide segment 72 and the sheet storage case 5. As described above, the conveying guide 7 is divided into the segment included in the sheet storage case 5 and the segment included in the apparatus main body 102, and the leading-edge wall 6 is also divided into the segment included in the sheet storage case 5 and the segment included in the apparatus main body 102. The division eliminates a likelihood that the sheet storage case 5 may hit the sheet feeding unit 4 when the sheet storage case 5 is loaded into the apparatus main body 102. Consequently, the space between the sheet storage case 5 and the sheet feeding unit 4 can be reduced, resulting in a reduction in size of the sheet feeder.

The above-described configuration can eliminate or reduce an increase in size of the sheet feeder 50. Additionally, the configuration allows a downstream end of the conveying guide 7 in the sheet feeding direction X to be located downstream of the nip between the feed roller 2 and the separation roller 3, thus enabling the sheet S to be stably guided.

Figure 4A:
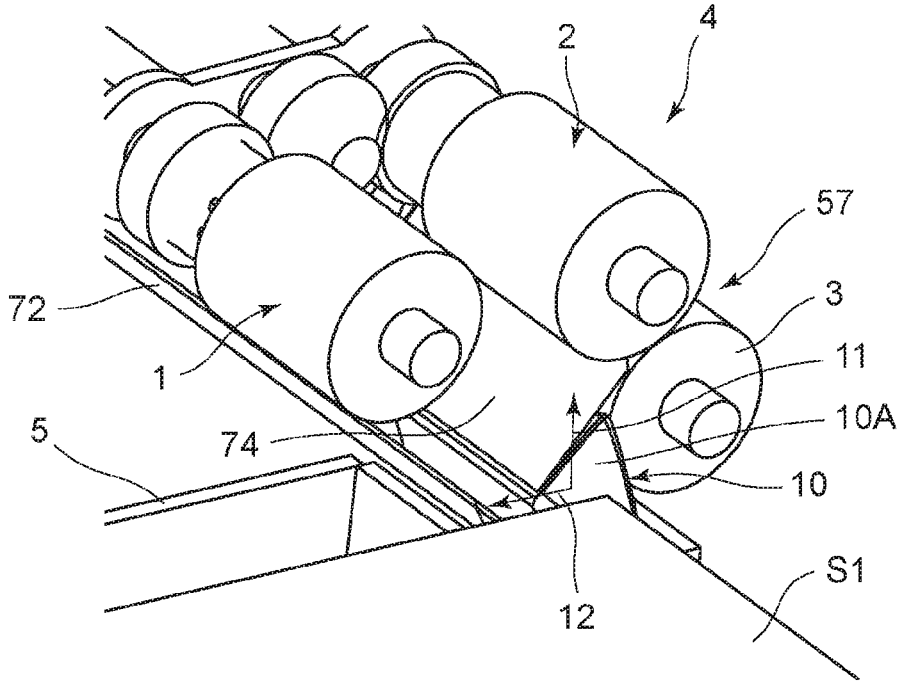
FIG. 4A is a perspective view of the sheet feeder of FIGS. 1A and 1B.
Figure 4B:
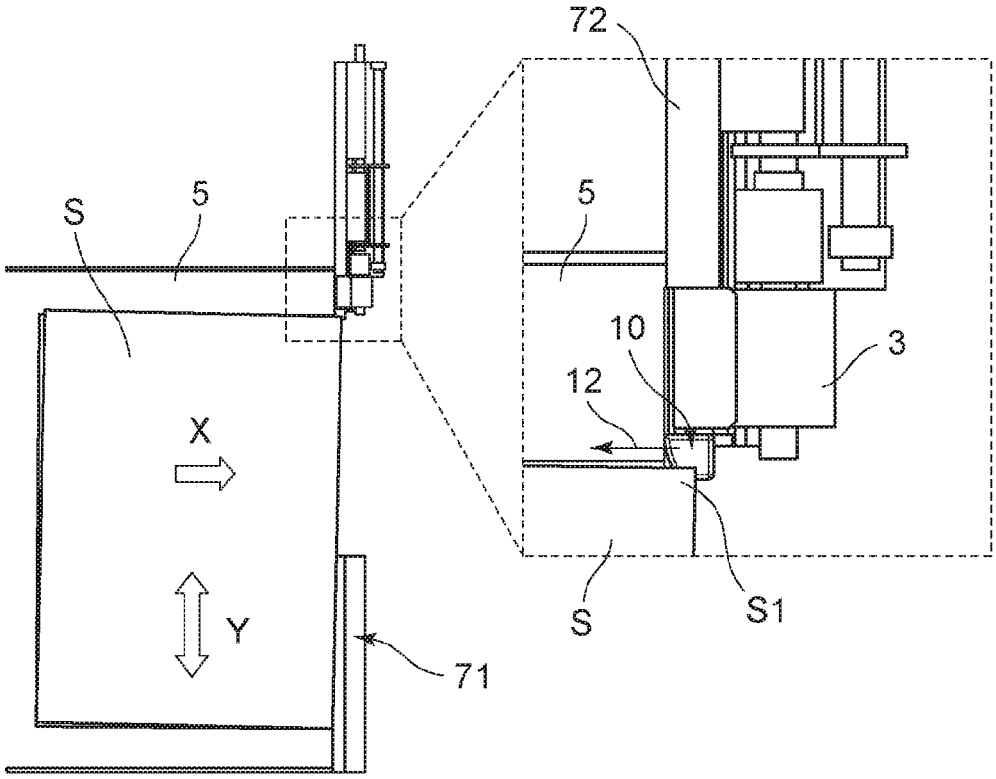
FIG. 4B is a plan view of the sheet feeder of FIGS. 1A and 1B.

Under conditions where the sheet storage case 5 is unloaded from the apparatus main body 102, however, the leading edges of the stored sheets S are not effectively regulated in the recess 5*a*. As illustrated in FIG. 4B, the stored sheet S may be skew and a leading edge corner S1 (hereinafter, also referred to as the "back-side leading edge corner S1"), located closer to the back of the sheet storage case 5, of the skew sheet S may project from the sheet storage case 5 in the sheet feeding direction X. If the back-side leading edge corner S1 of the sheet S is left projecting and the sheet storage case 5 is loaded into the apparatus main body 102, projecting part of the sheet S may be caught by an edge of the first guide segment 72 fixed to the apparatus main body 102. Unfortunately, the sheet S may be damaged, for example, folded. The orientation of the sheet S may be significantly changed, thus causing sheet misfeed.

It is therefore necessary to place an anti-catching member for preventing catching the sheet S at the end (facing the second guide segment 71) of the first guide segment 72 adjacent to the middle of the sheet storage case 5 in the widthwise direction Y.

Features of the sheet feeder 50 according to the first embodiment will now be described with reference to FIGS. 1A to 6.

An edge guide member 10 is disposed at the end of the first guide segment 72 of the conveying guide 7. The edge guide member 10 has an arcuate surface 10A, serving as a guide surface for preventing catching the back-side leading edge corner S1 of the sheet S. The edge guide member 10 is located on an upstream side of the first guide segment 72 in the loading direction. The arcuate surface 10A of the edge guide member 10 is arcuate or curved relative to the loading direction and the sheet feeding direction X. The edge guide member 10 may be integrated with the first guide segment 72. Alternatively, the edge guide member 10 may be a separate member having a guide surface and be joined to the first guide segment 72.

Figure 1A:
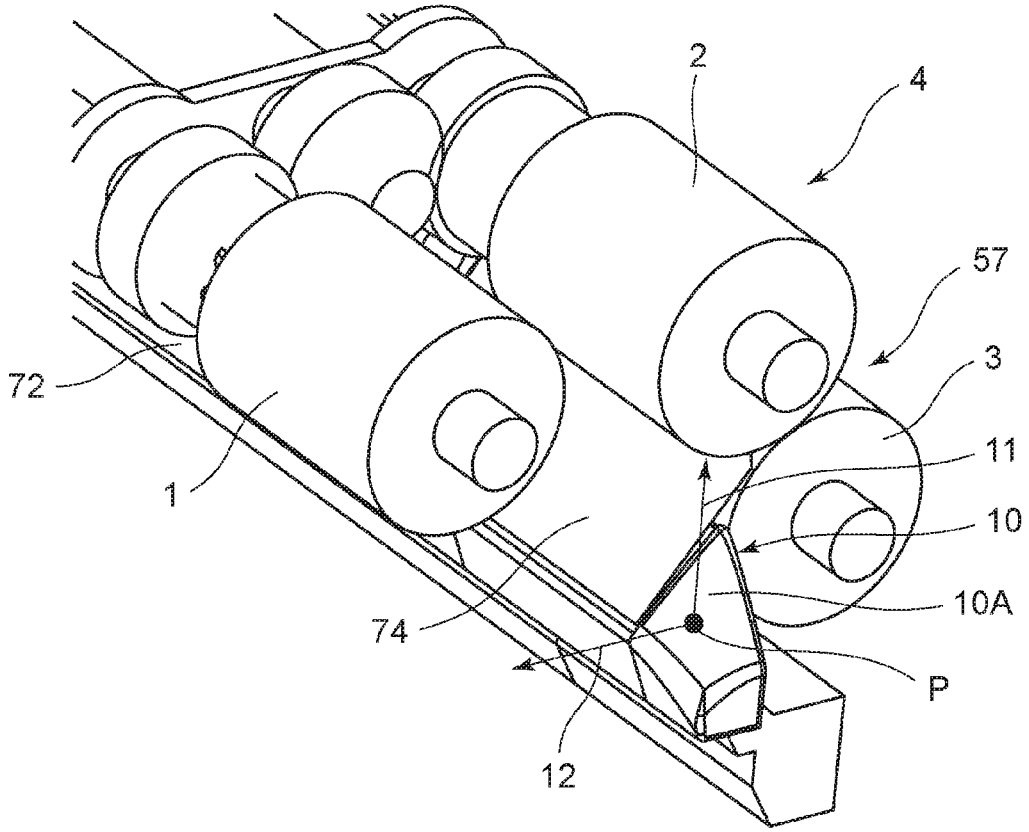
FIG. 1A is a perspective view illustrating a sheet feeding unit of a sheet feeder according to a first embodiment of the present invention.
Figure 1B:
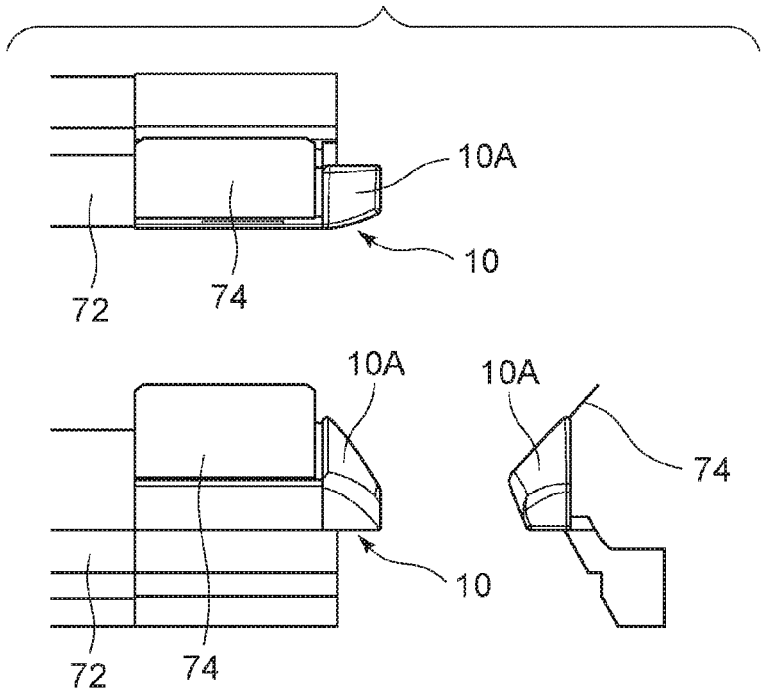
FIG. 1B includes three views illustrating a guide surface in FIG. 1A.

The arcuate surface 10A, serving as a guide surface, is located at a position where the back-side leading edge corner S1 of the sheet S can abut the arcuate surface 10A. When the leading edge corner S1 abuts the arcuate surface 10A, the sheet S receives reaction force from the arcuate surface 10A at an abutment position P. As illustrated in FIG. 1A, the arcuate surface 10A is a face shaped to, when the sheet S abuts the arcuate surface 10A, generate reaction force including a force component (hereinafter, "directional force component"), serving as a directional component 11, acting in an upward direction (vertically upward direction) normal to the arcuate surface 10A at the abutment position P and a force component (hereinafter, "directional force component"), serving as a directional component 12, acting in a direction opposite to the sheet feeding direction X. In other words, the arcuate surface 10A is shaped so that, when the leading edge of a sheet abuts the arcuate surface 10A at any position, reaction force is generated so as to include both a force component acting upward and a force component acting in the direction opposite to the sheet feeding direction X.

When the leading edge corner S1 of a sheet S abuts the arcuate surface 10A, therefore, the leading edge corner S1 of the sheet S receives force acting upward from the arcuate surface 10A and force acting in the direction opposite to the sheet feeding direction X. Consequently, when the leading edge corner S1 of the sheet S abuts the arcuate surface 10A, the leading edge corner S1 of the sheet S is raised and is moved in the direction opposite to the sheet feeding direction X (i.e., the direction in which the sheet S is returned to the sheet storage case 5).

Figure 5:
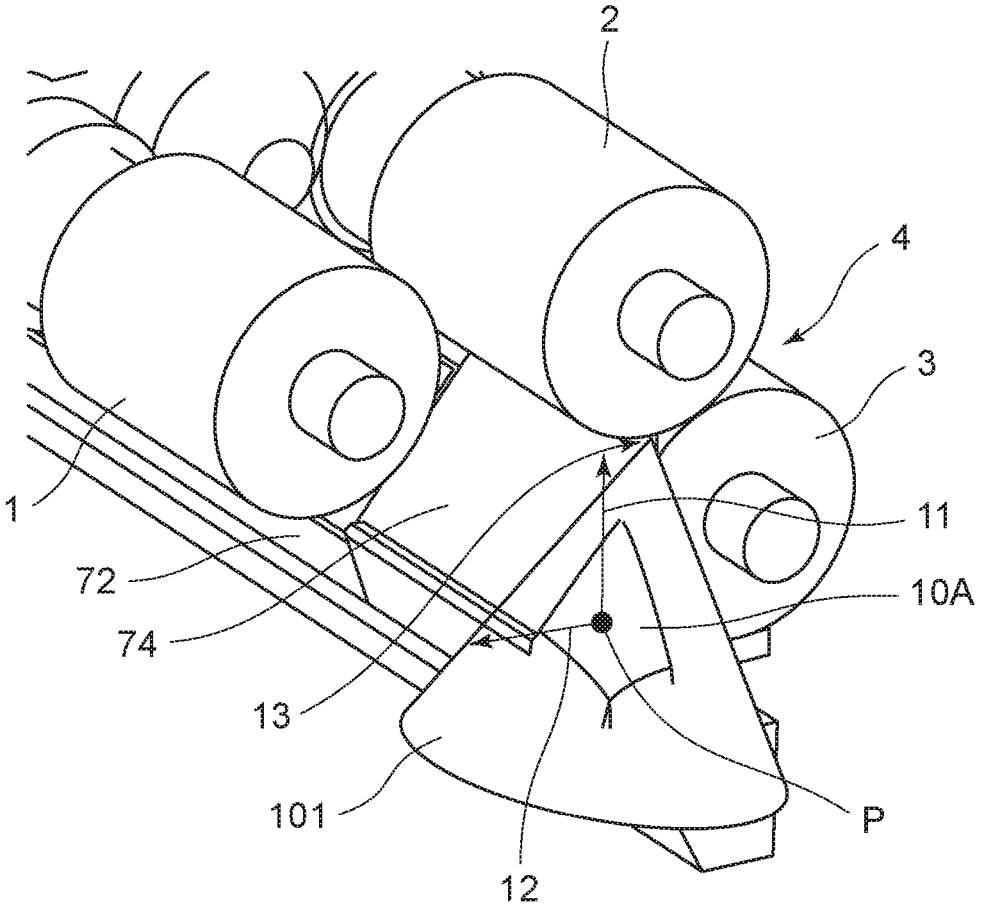
FIG. 5 is a schematic diagram illustrating an arcuate surface, serving as a guide surface, in the first embodiment.

Referring to FIG. 5, the arcuate surface 10A, serving as a guide surface, is disposed in the first embodiment. Specifically, the arcuate surface 10A is based on a conical surface. In other words, the arcuate surface 10A corresponds to a portion of the curved surface of a virtual cone 101 including the conical surface. The virtual cone 101 has a vertex that is adjacent to the lowest point 13 of the feed roller 2 and that is located upstream of the lowest point 13 in the sheet feeding direction X. Furthermore, the conical surface of the virtual cone 101 is smoothly coupled to the sheet guide surface of the nip guide member 74. In addition, the virtual cone 101 is disposed such that the conical surface including the arcuate surface 10A does not project upwardly beyond an extension of the sheet guide surfaces of the first guide segment 72 and the second guide segment 71. The virtual cone 101 is disposed such that the vertex and the curved surface satisfy the above-described positional relationship.

As described above, the edge guide member 10, located at the end of the first guide segment 72 adjacent to the middle of the sheet storage case 5 in the widthwise direction Y, has the arcuate surface 10A. If the leading edge corner S1 of the sheet S is left projecting from the sheet storage case 5 and the sheet storage case 5 is loaded into the apparatus main body 102, the sheet S will not be damaged. The reason is that when the leading edge corner S1 of the sheet S abuts the conical surface including the arcuate surface 10A during loading of the sheet storage case 5 into the apparatus main body 102, the leading edge corner S1 of the sheet S is raised and is moved in the direction opposite to the sheet feeding direction X. Additionally, when the raised leading edge corner S1 of the sheet S is moved onto the guide surface of the nip guide member 74, the projecting back-side leading edge corner S1 of the sheet S moves downward under its own weight on the sloping surface of the nip guide member 74. Thus, the sheet S having the leading edge corner S1 projecting in the sheet feeding direction X is further moved in the direction in which the sheet S is returned to the sheet storage case 5.

As described above, the vertex of the virtual cone 101 including the arcuate surface 10A is located adjacent to the lowest point 13 of the feed roller 2 in the sheet feeding direction X, and is also located upstream of the lowest point 13 in the sheet feeding direction X. This arrangement reduces a likelihood that, when the arcuate surface 10A raises the leading edge corner S1 of the sheet S, the sheet S, which may significantly jumps, would abut the feed roller 2.

As described above, when the sheet storage case 5 is loaded into the apparatus main body 102, the sheet S partly projecting from the sheet storage case 5 abuts the arcuate surface 10A, so that the sheet S receives force by which the sheet S is raised and force by which the sheet S is returned to the sheet storage case 5. Thus, the sheet S is rotated and moved to the sheet storage position. Additionally, since the leading edge corner S1 of the sheet S abuts the smooth arcuate surface 10A when the sheet S is raised and moved, the leading edge corner S1 of the sheet S is not damaged.

Consequently, a sheet can be prevented from being caught by the conveying guide 7, thus preventing any damage to the sheet. Additionally, the sheet can be prevented from changing its orientation, thus preventing sheet misfeed.

Second Embodiment

Figure 7:
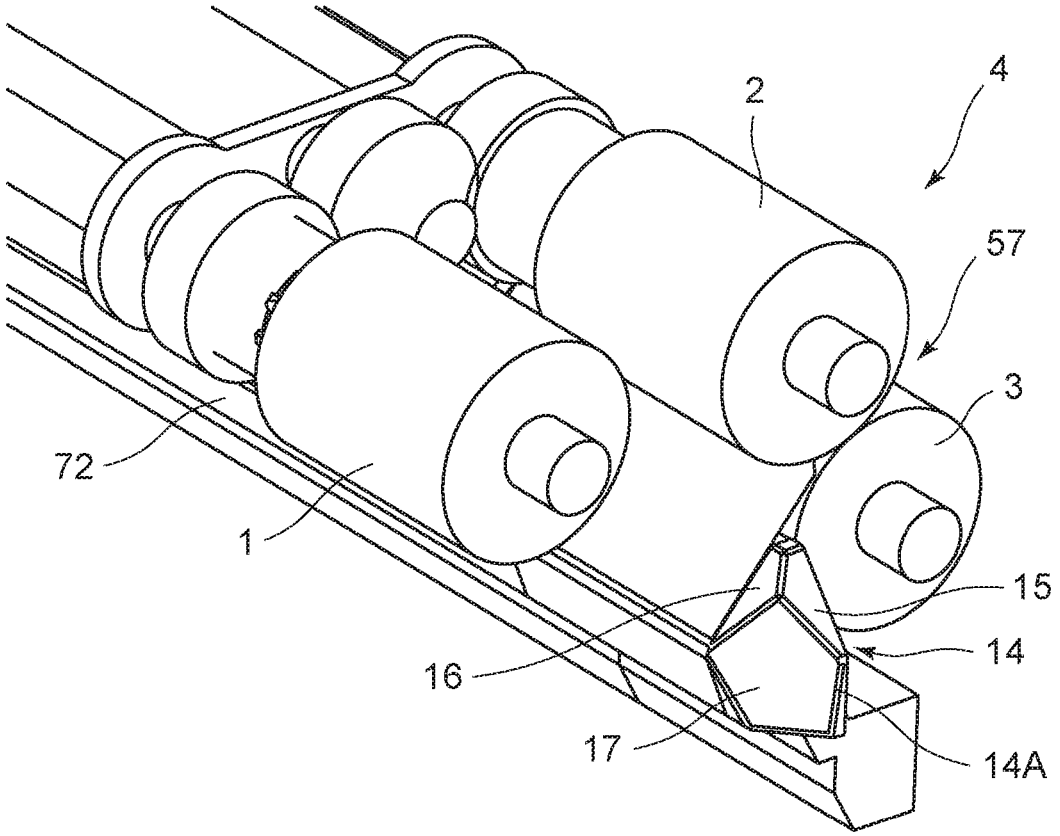
FIG. 7 is a perspective view illustrating a sheet feeding unit of a sheet feeder according to a second embodiment of the present invention.

A second embodiment will be described with reference to FIG. 7. Components different from those in the first embodiment will be described in detail. The other components are the same as those in the first embodiment and a description of these components is omitted. In the second embodiment, an edge guide member 14 is disposed at an end of the first guide segment 72 of the conveying guide 7. The edge guide member 14 has a multi-faceted guide surface 14A, serving as a guide surface. The multi-faceted guide surface 14A includes a first facet 15 that is flat and a second facet 16 that is flat. At the first facet 15, when the leading edge corner S1 of a sheet S abuts the multi-faceted guide surface 14A, a directional force component of reaction force generated acts upward. At the second facet 16, a directional force component of the reaction force acts in a direction opposite to the sheet feeding direction X. The multi-faceted guide surface 14A further includes a third facet 17 that is flat and is connected to the first facet 15 and the second facet 16. The third facet 17 allows reaction force including a directional force component acting upward and a directional force component acting in the direction opposite to the sheet feeding direction X to be generated when the sheet S abuts against the third facet 17. These first to third facets 15 to 17 are arranged such that the facets slope in the loading direction and the sheet feeding direction X.

This configuration allows the back-side leading edge corner S1 of a stored sheet S to abut the third facet 17 of the multi-faceted guide surface 14A, disposed at the end of the first guide segment 72 of the conveying guide 7, during loading of the sheet storage case 5 into the apparatus main body 102. The leading edge corner S1 of the sheet S abutted the third facet 17 is raised and is moved in the direction opposite to the sheet feeding direction X. The leading edge corner S1 of the sheet S is further raised by the first facet 15, and is further moved in the direction opposite to the sheet feeding direction X by the second facet 16. Thus, the sheet S is moved so as to return to the sheet storage case 5 as described in the first embodiment. Consequently, the sheet S can be prevented from being caught by the conveying guide 7, thus preventing any damage to the sheet S. Additionally, the sheet S can be prevented from changing its orientation, thus preventing sheet misfeed.

The above-described first and second embodiments will now be described in more detail.

The edge guide member (10, 14) at the end of the first guide segment 72 of the conveying guide 7 has the guide surface (the arcuate surface 10A, the multi-faceted guide surface 14A), and prevents the leading edge corner S1 of a projecting sheet S from being caught during loading of the sheet storage case 5 into the apparatus main body 102. The followings are of importance to the guide surface.

If the guide surface is shaped to merely raise part of the sheet S projecting from the sheet storage case 5, the leading edge of the raised sheet may be caught by the sheet feeding unit 4 disposed above the sheet. Furthermore, if the guide surface is shaped to merely move part of the sheet S projecting from the sheet storage case 5 in the direction opposite to the sheet feeding direction X, a large force may be applied to the sheet S when the leading edge of the sheet S abuts the guide surface, resulting in damage to the sheet S.

The guide surface at the end of the first guide segment 72, therefore, has to raise the back-side leading edge corner S1 of the sheet S projecting from the sheet storage case 5 and move the sheet S in the direction opposite to the sheet feeding direction X simultaneously or continuously as the sheet storage case 5 is loaded into the apparatus main body 102. Specifically, the guide surface disposed at the first guide segment 72 of the conveying guide 7 is required to raise the leading edge corner S1 of the sheet S and move the sheet S in the direction in which the sheet S is returned to the sheet storage case 5. The term "continuously" as used herein refers to an action in which raising the leading edge corner S1 of the sheet S and moving the sheet S in the direction opposite to the sheet feeding direction X are performed not at exactly the same time but substantially simultaneously, or sequentially. In some embodiments, the guide surface is formed so that the guide surface raises the leading edge corner S1 of the sheet S and then moves the sheet S in the direction opposite to the sheet feeding direction X in a continuous manner.

In the first embodiment, the guide surface is the conical surface. The conical surface can raise the leading edge corner S1 of the sheet S and return the sheet S to the sheet storage case 5 simultaneously or continuously. Similarly, in the second embodiment, the guide surface includes many flat facets that face in different directions and, accordingly, can raise the back-side leading edge corner S1 of the sheet S and return the sheet S to the sheet storage case 5 simultaneously or continuously. Consequently, the sheet S can be prevented from being caught by the conveying guide 7, thus preventing any damage to the sheet S. Additionally, the sheet S can be prevented from changing its orientation, thus preventing sheet misfeed.

The guide surface may satisfy the above-described requirements. For example, the guide surface may be part of the curved surface of a cylinder and be smoothly connected to the sheet guide surface of the nip guide member 74. In the second embodiment, the guide surface includes the three flat facets. The guide surface may include four or more flat facets. In other words, the guide surface may be a combination of flat facets at different inclination angles in different inclination directions.

In each of the first and second embodiments, as described above, the conveying guide 7 is divided into the second guide segment 71 included in the sheet storage case 5 and the first guide segment 72 included in the apparatus main body 102. This configuration can prevent the leading edge corner S1 of a sheet S from being caught by the conveying guide 7. Consequently, the sheet feeder reduced in size can be configured such that a sheet can be prevented from being caught when the sheet storage case is loaded into the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-062574, filed Mar. 25, 2015, which is hereby incorporated by reference herein in its entirety.

What is claimed is:

1. A sheet feeder comprising:

a sheet storage unit that stores a sheet, the sheet storage unit being loadable into an apparatus main body;

a sheet feeding unit configured to feed the sheet from the sheet storage unit in a second direction orthogonal to a first direction in which the sheet storage unit is loaded into the apparatus main body;

a conveying guide configured to guide the sheet fed in the second direction by the sheet feeding unit, the conveying guide including a first guide segment included in the apparatus main body and a second guide segment included in the sheet storage unit, the second guide segment being aligned with the first guide segment in the first direction while the sheet storage unit is loaded in the apparatus main body; and an edge guide member disposed at an upstream end of the first guide segment in the first direction, the edge guide member having a guide surface shaped to, when the sheet abuts the guide surface, generate reaction force including a directional force component acting upward and a directional force component acting in a direction opposite to the second direction.

2. The sheet feeder according to claim 1, wherein the guide surface is part of a conical surface.

3. The sheet feeder according to claim 2, wherein the conical surface is based on a virtual cone, wherein the virtual cone has a vertex that is disposed adjacent to a lowest point of the sheet feeding unit and that is located upstream of the lowest point in the second direction, and wherein the first guide segment and the second guide segment each have a sheet guide surface, and the virtual cone is disposed such that the conical surface does not project upwardly beyond an extension of the sheet guide surface of each of the first and second guide segments.

4. The sheet feeder according to claim 1, wherein the guide surface includes a plurality of flat facets including a first facet at which the directional force component of the reaction force, generated when the sheet abuts the guide surface, acts upward, a second facet at which the directional force component of the reaction force acts in the direction opposite to the second direction, and a third facet that is connected to the first and second facets and that allows the reaction force including the directional force component acting upward and the directional force component acting in the direction opposite to the second direction to be generated when the sheet abuts the guide surface.

5. The sheet feeder according to claim 1, wherein the first guide segment and the second guide segment each have a sheet guide surface, and the sheet guide surfaces of the first and second guide segments are substantially identical to each other in shape, and wherein while the sheet storage unit is loaded in the apparatus main body, the sheet guide surfaces of the first and second guide segments are substantially flush with each other.

6. The sheet feeder according to claim 5, wherein the first guide segment included in the apparatus main body extends from a downstream side of the sheet storage unit in the first direction to substantially a middle of a sheet conveyance area, and wherein the edge guide member is disposed at the end of the first guide segment adjacent to the middle of the sheet conveyance area.

7. The sheet feeder according to claim 1, wherein the sheet storage unit has a recess that receives the first guide segment while the sheet storage unit is loaded in the apparatus main body.

8. The sheet feeder according to claim 1, wherein the sheet feeding unit faces the first guide segment while the sheet storage unit is loaded in the apparatus main body.

9. A sheet feeder comprising:

a sheet storage unit that stores a sheet, the sheet storage unit being loadable into an apparatus main body;

a sheet feeding unit configured to feed the sheet from the sheet storage unit in a second direction orthogonal to a first direction in which the sheet storage unit is loaded into the apparatus main body;

a conveying guide configured to guide the sheet fed in the second direction by the sheet feeding unit, the conveying guide including a first guide segment included in the apparatus main body and a second guide segment included in the sheet storage unit, the second guide segment being aligned with the first guide segment in the first direction while the sheet storage unit is loaded in the apparatus main body; and an edge guide member that is disposed at an upstream end of the first guide segment in the first direction and against which the sheet partly projecting from the sheet storage unit is allowed to abut during loading of the sheet storage unit into the apparatus main body, the edge guide member having a guide surface that raises projecting part of the sheet and moves the sheet in a direction opposite to the second direction simultaneously or continuously.

10. The sheet feeder according to claim 9, wherein the guide surface is part of a conical surface.

11. The sheet feeder according to claim 9, wherein the guide surface is a combination of flat facets at different inclination angles in different inclination directions.

12. The sheet feeder according to claim 9, wherein the sheet storage unit has a recess that receives the first guide segment while the sheet storage unit is loaded in the apparatus main body.

13. The sheet feeder according to claim 9, wherein the sheet feeding unit faces the first guide segment while the sheet storage unit is loaded in the apparatus main body.

14. An image forming apparatus comprising:

an apparatus main body;

a sheet feeder including a sheet storage unit that stores a sheet, the sheet storage unit being loadable into the apparatus main body, a sheet feeding unit configured to feed the sheet from the sheet storage unit in a second direction orthogonal to a first direction in which the sheet storage unit is loaded into the apparatus main body, a conveying guide configured to guide the sheet fed in the second direction by the sheet feeding unit, the conveying guide including a first guide segment included in the apparatus main body and a second guide segment included in the sheet storage unit, the second guide segment being aligned with the first guide segment in the first direction while the sheet storage unit is loaded in the apparatus main body, and an edge guide member disposed at an upstream end of the first guide segment in the first direction, the edge guide member having a guide surface shaped to, when the sheets abuts the guide surface, generate reaction force including a directional force component acting upward and a directional force component acting in a direction opposite to the second direction; and an image forming unit configured to form an image on the sheet fed from the sheet feeder.

15. An image forming apparatus comprising:

an apparatus main body;

a sheet feeder including a sheet storage unit that stores a sheet, the sheet storage unit being loadable into the apparatus main body, a sheet feeding unit configured to feed the sheet from the sheet storage unit in a second direction orthogonal to a first direction in which the sheet storage unit is loaded into the apparatus main body, a conveying guide configured to guide the sheet fed in the second direction by the sheet feeding unit, the conveying guide including a first guide segment included in the apparatus main body and a second guide segment included in the sheet storage unit, the second guide segment being aligned with the first guide segment in the first direction while the sheet storage unit is loaded in the apparatus main body, and an edge guide member that is disposed at an upstream end of the first guide segment in the first direction and against which the sheet partly projecting from the sheet storage unit is allowed to abut during loading of the sheet storage unit into the apparatus main body, the edge guide member having a guide surface that raises projecting part of the sheet and moves the sheet in a direction opposite to the second direction simultaneously or continuously; and an image forming unit configured to form an image on the sheet fed from the sheet feeder.

* * * * *